US010330271B2

(12) United States Patent
Giorgini et al.

(10) Patent No.: US 10,330,271 B2
(45) Date of Patent: Jun. 25, 2019

(54) ADJUSTABLE LAMP FOR ILLUMINATION SETTING HAVING ELASTICALLY PLIABLE UNIT FOR EXERTING PRESSURE ON LOAD-BEARING ELECTRIC CABLE

(71) Applicant: LEUCOS S.R.L., Salzano (IT)

(72) Inventors: Gabriele Giorgini, Zero Branco (IT); Luca Toso, Padua (IT)

(73) Assignee: CLANN S.R.L., Romano d'Ezzelino (IT)

( * ) Notice: Subject to any disclaimer, the term of this patent is extended or adjusted under 35 U.S.C. 154(b) by 39 days.

(21) Appl. No.: 15/446,027

(22) Filed: Mar. 1, 2017

(65) Prior Publication Data

US 2017/0254493 A1 Sep. 7, 2017

(30) Foreign Application Priority Data

Mar. 1, 2016 (IT) ..... 102016000021546

(51) Int. Cl.
*F21K 9/66* (2016.01)
*F21S 8/06* (2006.01)
(Continued)

(52) U.S. Cl.
CPC ..... *F21S 8/061* (2013.01); *F21K 9/275* (2016.08); *F21K 9/278* (2016.08); *F21K 9/66* (2016.08);
(Continued)

(58) Field of Classification Search
CPC ..... F21V 23/06; F21V 21/14; F21V 21/112; F21V 21/104; F21V 21/10; F21V 21/008; F21V 21/002; F21V 17/08; F21V 21/005; F21V 21/025; F21K 9/278; F21K 9/275; F21K 9/66; F21Y 2103/10; F21Y 2115/10
See application file for complete search history.

(56) References Cited

U.S. PATENT DOCUMENTS 9,618,164 B1 * 4/2017 Berry ..... F21V 23/06
2003/0137835 A1 * 7/2003 Mier-Langner ..... F21S 8/06 362/220

(Continued)

FOREIGN PATENT DOCUMENTS

CN 204328799 U * 5/2015
DE 202015004594 U1 * 7/2015 ..... F21S 8/061
DE 202016000575 u1 * 2/2016 ..... F21S 8/061

OTHER PUBLICATIONS

Translation of DE 20 2015 004 594 U1.*
Translation of CN 204328799 U.*
Translation of DE 20 2016 000 575 U1.*

*Primary Examiner* — Jong-Suk (James) Lee
*Assistant Examiner* — Christopher E Dunay
(74) *Attorney, Agent, or Firm* — Mark M. Friedman

(57) ABSTRACT

Adjustable lamp for illuminating a setting which comprises at least two load-bearing electrically-conductive electric cables, an illuminating body extended with main extension along a longitudinal axis, supported suspended by the load-bearing electric cables and comprising an illumination source, first and second electrical connection elements mechanically associated with the illuminating body at at least two sections thereof spaced from each other, respectively electrically connected to the two load-bearing cables in order to electrically power the adjustable lamp.

12 Claims, 4 Drawing Sheets

(51) Int. Cl.

| | |
|---|---|
| ***F21V 21/002*** | (2006.01) |
| ***F21V 21/112*** | (2006.01) |
| ***F21V 21/14*** | (2006.01) |
| ***F21K 9/275*** | (2016.01) |
| ***F21K 9/278*** | (2016.01) |
| ***F21V 17/08*** | (2006.01) |
| ***F21V 21/008*** | (2006.01) |
| ***F21V 23/06*** | (2006.01) |
| *F21V 21/005* | (2006.01) |
| *F21V 21/30* | (2006.01) |
| *F21Y 103/10* | (2016.01) |
| *F21Y 115/10* | (2016.01) |

(52) U.S. Cl.

CPC ..... *F21V 17/08* (2013.01); *F21V 21/002* (2013.01); *F21V 21/008* (2013.01); *F21V 21/112* (2013.01); *F21V 21/14* (2013.01); *F21V 23/06* (2013.01); *F21V 21/005* (2013.01); *F21V 21/30* (2013.01); *F21Y 2103/10* (2016.08); *F21Y 2115/10* (2016.08)

(56) References Cited

U.S. PATENT DOCUMENTS

2014/0247585 A1* 9/2014 Chien ..... F21V 19/003
362/217.17
2016/0033098 A1* 2/2016 Bergman ..... H02G 3/20
362/418

* cited by examiner

ADJUSTABLE LAMP FOR ILLUMINATION SETTING HAVING ELASTICALLY PLIABLE UNIT FOR EXERTING PRESSURE ON LOAD-BEARING ELECTRIC CABLE

FIELD OF APPLICATION

The present invention regards a lamp for illuminating settings, according to the preamble of the independent claim 1.

The present adjustable lamp is intended to be employed in the field of illuminating engineering, for illuminating settings of any type, private or public, home or office, displays/exhibitions or another destination.

More particularly, the adjustable lamp, object of the present invention, is advantageously employable for illuminating, with an adjustable, easy-to-vary angle, a setting that requires an optimal illumination in various areas.

The invention is therefore inserted in the context of the industrial field of production of illuminating bodies such as lamps and light fixtures, i.e. more generally, in the illuminating engineering field.

STATE OF THE ART

In the scope of the illuminating engineering field, there is the particular need to illuminate settings by means of lamps that are efficient with regard to electrical energy consumption and simultaneously aesthetically pleasing, and simultaneously provided with good quality design. In particular, in recent years, the growing need of a high electrical efficiency has facilitated the use of illumination sources constituted by light-emitting diodes (LEDs) which, give the same illumination, are well-known to have low electrical energy consumption with respect to other sources, such as neon tubes and the conventional incandescent lamps.

In operation, the LEDs irradiate, as is known, the electromagnetic waves in a very delimited light cone, which allows obtaining a selective illumination of the setting, i.e. a high luminance in the eyes of the observer.

LED lamps are also known with elongated tubular shape, which are adjustable in order to change the irradiation direction.

More particularly, adjustable lamps are known from the patents GB 2451551 and TW1322248, each comprising two lateral supports made of plastic material, intended to be mechanically constrained to a wall of a room, a tubular illuminating body housing an LED strip, interposed between the lateral supports and mechanically and rotatably connected thereto by means of two pins. In operation, such adjustable lamps of known type are thus free to rotate around their own central main extension axis in order adjust the direction of the light cone emitted by the LEDs.

The aforesaid lateral supports are also further equipped with electrical connectors in order to power the LED strip of the adjustable lamp with the requested electrical power. The adjustable lamps of known type described up to know have in practice demonstrated not free of drawbacks.

One drawback lies in the fact that such lamps can only rotate a few degrees, and consequently are only able to illuminate the limited areas comprised between the adjustment angles.

A further drawback lies in the fact that the tubular illuminating body of each of these adjustable lamps of known type is hard to substitute in case of failure. Indeed, for such purpose, the aforesaid lamps require disassembling the lateral supports, to which the illuminating body is constrained. Such disassembly operation is not at all easy, if compared with the simpler unscrewing of a light bulb and requires technical competencies that are not commonly held by the final user.

For such purpose, an adjustable lamp is known from the patent JP 4208618 that also comprises two lateral supports intended to be mechanically constrained to a wall of a room, and an illuminating body, interposed between the lateral supports and mechanically and rotatably connected thereto by means of two pins. In operation, such illuminating body is adapted to be fit between the two lateral supports by means of two locking elements, which allow the illuminating body to be mounted, with shape engagement, without having to disassemble the two lateral support bodies. However, the freedom of rotation around the main extension axis of the illuminating body is further limited with respect to the above-described adjustable lamps and the illuminating body is therefore rotatable only for a few degrees.

A further drawback of the adjustable lamps of known type, considered up to now, lies in the fact that the aforesaid lateral supports are very bulky and hence not particularly pleasing aesthetically.

More generally, the technical and structural characteristics of these lamps strongly limit the possibility of attaining a good quality design thereof and hence the possibilities of use in architecturally-designed settings, in which in particular today clean lines and simple geometric figures are increasingly desired.

PRESENTATION OF THE INVENTION

In this situation, the problem underlying the present invention is therefore that of overcoming the drawbacks manifested by the adjustable lamps of known type, by providing an adjustable lamp, which is susceptible of optimally illuminating since it can easily rotate around its own main extension axis for an entire round angle, and simultaneously able to be easily locked in any one desired illumination orientation.

A further object of the present invention is to provide an adjustable lamp which is simple to assemble and place in operation, and that simultaneously allows a simple and quick disassembly, in case of failure or normal periodic cleaning.

A further object of the present invention is to provide an adjustable lamp whose technical characteristics do not negatively impact the aesthetic design characteristics.

A further object of the adjustable lamp, object of the present invention, is to provide a lamp that is safe and reliable in use.

A further object of the present invention is to provide an adjustable lamp which can be made with an illuminating body that extends considerably in the main extension direction, so to be able to illuminate a setting that is also quite wide.

BRIEF DESCRIPTION OF THE DRAWINGS

The technical characteristics of the invention, according to the aforesaid objects, are clearly seen from the contents of the below-reported claims and the advantages thereof will be more evident in the following detailed description, made with reference to the enclosed drawings which represent a merely exemplifying and non-limiting embodiment of the invention, in which:

DETAILED DESCRIPTION OF A PREFERRED EMBODIMENT

With reference to the enclosed drawings, reference number 1 overall indicates an adjustable lamp for illuminating a setting, according to the present invention.

This is intended to be employed for illuminating settings of different type (civilian, offices) and different context (private or public), or even for illuminating areas dedicated for the presentation of products such as display cases, items in museum, paintings in galleries or for still other destinations. More generally, the adjustable lamp 1, object of the present invention, is intended for a use where there is the particular technical need to have a precise adjustable illumination, as well the aesthetic need to have a good quality design.

Figure 1:
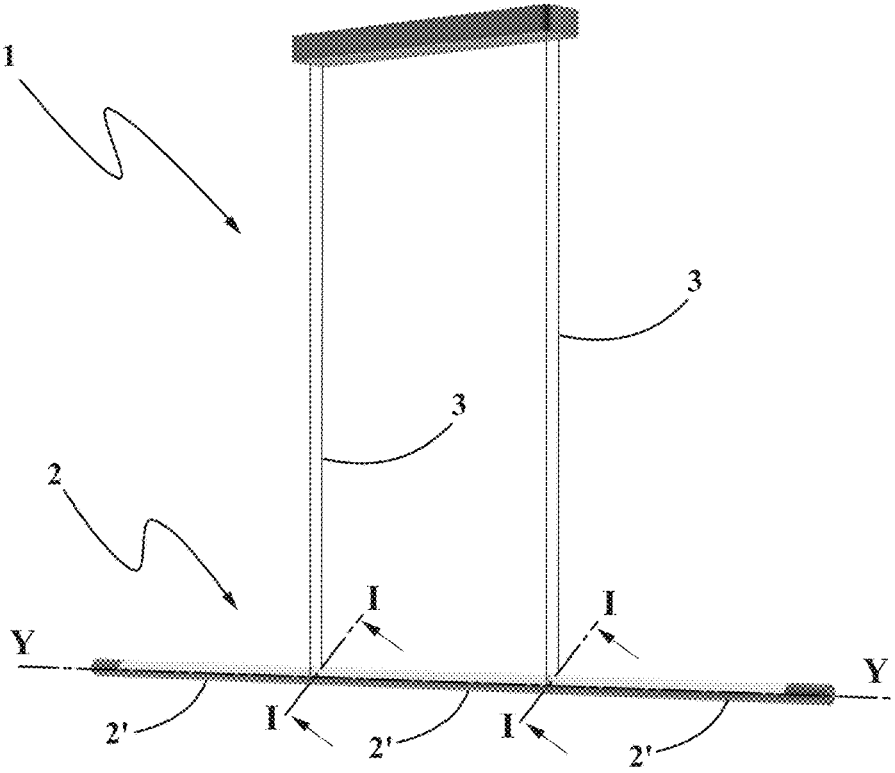
FIG. 1 shows an overall perspective view of the adjustable lamp, object of the present invention.
Figure 2:
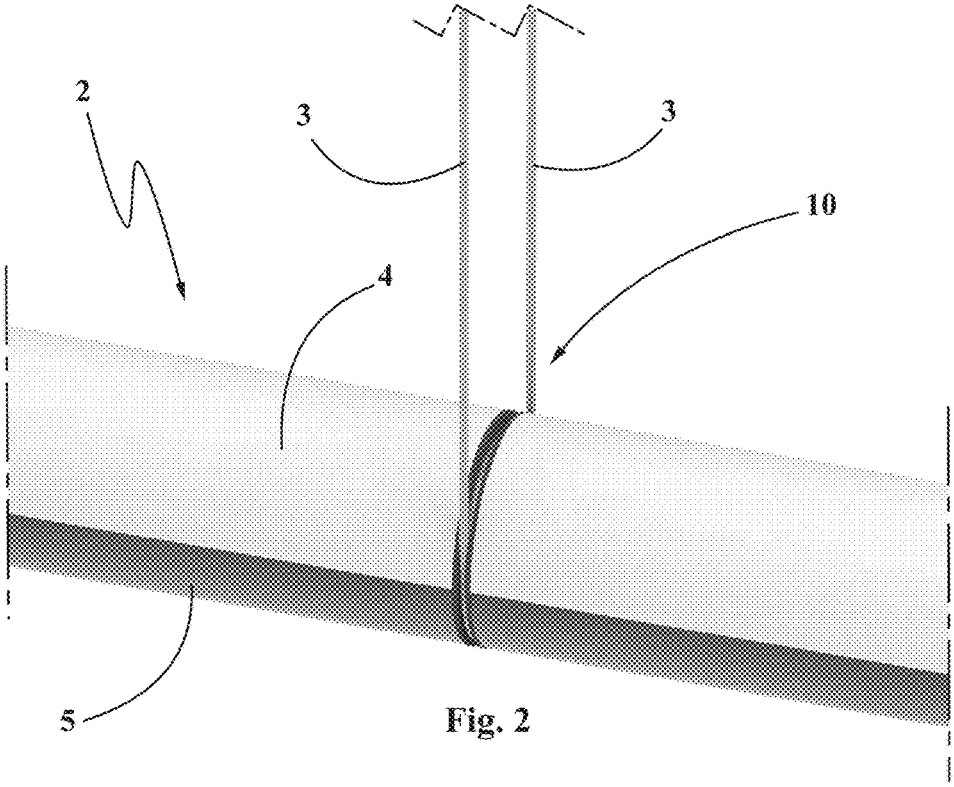
FIG. 2 shows an enlarged detail of the adjustable lamp of FIG. 1, at a connection of a load-bearing electric cable with the illuminating body of the adjustable lamp.

In accordance with the embodiment illustrated in the enclosed FIG. 1, the adjustable lamp 1 comprises an extended illuminating body 2, with substantially tubular shape, preferably cylindrical, which has main extension along the direction of a longitudinal axis Y. Such illuminating body 2 comprises a support body 5 made of rigid material, e.g. an aluminum extrusion and a shell 4 made of transparent or semi-transparent semi-rigid material and/or colored, e.g. polymethylmethacrylate (PMMA), intended to be traversed by the light. The support body 5 is rigid and has a structural function for the illuminating body 2, allowing the preservation over time of its rectilinear form without yielding to bending caused by the weight, or to the shear stresses with respect to the support points, as clarified hereinbelow.

Figure 3:
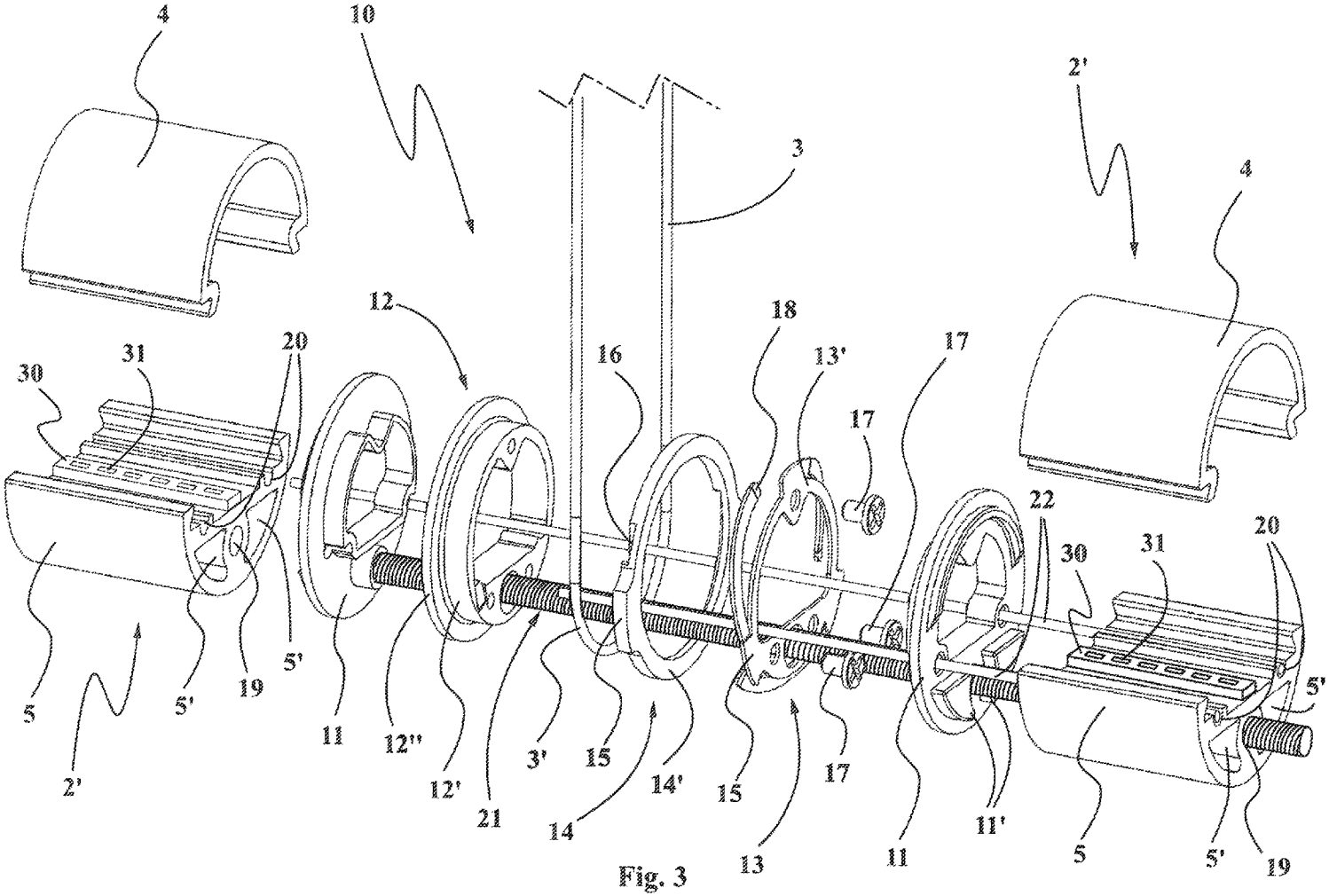
FIG. 3 shows an exploded schematic view of a detail of the adjustable lamp, object of the present invention, relative to electrical connection elements arranged at the enlarged detail illustrated in FIG. 2.

Advantageously, the aforesaid support body 5 (indicated with tubular shape, which in accordance with the most general idea of the invention can also be obtained with a solid tubular body) has at least one longitudinal cavity 5' parallel to the axis Y for lightening the illuminating body 2 and, in particular according to the embodiment illustrated in FIG. 3, has at least two longitudinal cavities 5' parallel to the axis Y. Such cavities 5' can be extended for one part of the length of each module 2' of the illuminating body 2 or for the entire length thereof.

The adjustable lamp 1 also comprises an illumination source 30, preferably comprising at least one strip 31 of light-emitting diodes (LED) 32 mechanically mounted on the support body 5 and extended parallel to the aforesaid longitudinal axis Y for at least one section of the length of the illuminating body 2.

The shell 4 is susceptible of being mechanically engaged with the support body 5 in order to make a closed box-like body and treat the light exiting from the illuminating body 2 with desired refraction effects.

In particular, in accordance with the preferred and non-limiting embodiment illustrated in the enclosed FIG. 3, the shell 4 has semi-cylindrical cap form and is mechanically constrained to the support body 5, also preferably with semi-cylindrical form, by means of a male-female coupling attainable by means of elastic deformation, in particular of the shell 4. Fixing screws can be further or otherwise provided in order to fix the shell 4 to the support body 5, in a manner per se easy to complete for the person skilled in the art. More in detail, the shell 4 has, at the two longitudinal edges parallel to the axis Y, two elongated projecting ribs, diametrically opposite with respect to each other and susceptible of forming two male terminals of engagement of the abovementioned male/female coupling. Such two male terminals are shaped and intended to be inserted in the support body 5, which has two elongated slits, also with longitudinal extension parallel to the axis Y, arranged mirrored to the male terminals of the shell 4 and in turn susceptible of forming two female terminals engaged in a shape relationship with the male terminals in order to make the abovementioned male/female coupling.

In this manner, by pressing the shell 4 against the support body 5 or vice versa, the coupling with fitting of male/female type occurs, by means of which the shell 4 remains mechanically constrained to the support body 5 of the illuminating body 2 preferably without further fixing elements such as screws or the like.

The male-shaped terminals and the female-shaped terminals can be reversed with respect to the two components to be constrained, without departing from the scope of the patent.

Hence, by simply operating on the shell 4, it is possible to overcome an elastic retention force of the two coupled components 4, 5 and free the shell 4 from the support body 5. More in detail, with such operation it is possible to move the shell 4 between a position separate from the support body 5, in which the illuminating body 2 is in an open configuration and allows accessing the illumination source 30 in order to perform maintenance thereon or substitute it with another new source if it is consumed, and a position of joining with the support body 5, in which the illuminating body 2 is in a closed configuration and attains a compact box-like body.

Preferably, if the illumination source 30 is obtained with two or more LEDs 32, the latter will be advantageously mounted aligned on a strip 31 of rigid or semi-rigid material with linear extension, which acts as connection (both electrical and mechanical) for the illumination source 30 itself.

Such strip 31 is installed on one face of the support body 5 with extension parallel to the longitudinal axis Y of the illuminating body 2 and which is facing and covered by the shell 4 that intercepts the light rays thereof.

Advantageously, the illuminating body 2 of the adjustable lamp 1 is supported by two load-bearing electric cables 3, which are positioned spaced along the aforesaid longitudinal extension in a manner such to horizontally support it in a stable manner.

Each cable forms an elongated U (in at least one lower section), in accordance with that depicted in the enclosed figures and as better specified hereinbelow.

Preferably, each of the two load-bearing electric cables 3 has two ends, which are mechanically constrained to an upper internal support of the setting to be illuminated, for example the ceiling of a room or a beam or another suitable support.

Advantageously, each of the aforesaid load-bearing cables 3, which support the weight of the illuminating body 2, is connected to the latter by a curved portion 3' of the same illuminating body 2, which is at the vertex of the U shape, or opposite the two constrained ends. The curved portions 3' of the two load-bearing cables 3 intercept the illuminating body 2 in two corresponding sections thereof, each of which arranged transverse to the longitudinal axis Y and, in accordance with that depicted in FIG. 1, is spaced from the other.

In accordance with one embodiment of the present invention, the adjustable lamp 1 also comprises a box-like containment body, which can be mechanically constrained above the illuminating body 2, i.e. fixable to the ceiling or to a beam of the setting to be illuminated.

From the containment body, the two load-bearing cables 3 are extended towards the illuminating body starting from the ends opposite the U-shaped concavity, in accordance with that illustrated in FIG. 1. The aforesaid containment body is adapted to house suitable electric power supply elements at its interior and hide them from user sight, such elements including AC/DC rectifier electronic circuit and a DC/DC direct current step-down electronic circuit. Such electric power supply elements are not shown in the enclosed figures and will not be described in more detail since they correspond with technologies that are per se known to the person skilled in the art.

In accordance with a further embodiment not depicted in the enclosed figures, the containment body can be omitted and the electric power supply elements are installed in a distal position with respect to the adjustable lamp 1, e.g. embedded and hidden in a wall of the setting to be illuminated.

Otherwise, in accordance with a further embodiment, also not depicted in the enclosed figures and easy to attain by the person skilled in the art, the power supply elements are housed inside the illuminating body 2. For such purpose, the illuminating body 2 will be sized to receive the bulk of such power supply elements, for example by providing for an enlarged cross section and/or increasing the length thereof in longitudinal direction Y and hence increasing the available internal volume.

According to one particular characteristic of the invention, the aforesaid load-bearing electric cables 3, in addition to supporting the weight of the illuminating body 2 of the adjustable lamp 1, are adapted to power the illumination source 30 with the requested electrical power.

Preferably, the two load-bearing electric cables 3 are power supplied under direct voltage, one at a positive potential and the other negative.

Advantageously, the electrical power is transmitted by the electric power supply elements to the illumination source 30, by means of electrical connection elements 10 mechanically constrained to the illuminating body 2 and in contact with the curved portions of the load-bearing electric cables 3 in order to conduct the electric current towards the illumination source 30.

More in detail and in accordance with the embodiment depicted in FIG. 1, the illuminating body 2 of the adjustable lamp 1 is divided at the sections thereof, into three modules 2', each of which mechanically associated with the electrical connection elements 10, which are interposed between the aforesaid modules 2'.

The three modules 2' are mechanically connected to each other by means of fixing elements 21 that operate on the corresponding portions of the support bodies 5 of the modules 2', joining them together. In particular, such fixing elements 21 can comprise a tie rod obtained with a threaded metallic bar passing inside and longitudinally with respect to the support body 5, in particular through a through hole 19 parallel to the longitudinal axis Y. The tie rod is preferably extended for the entire length of the illuminating body, since it is mechanically constrained at its threaded ends for example by means of nuts or bolts.

Figure 4:
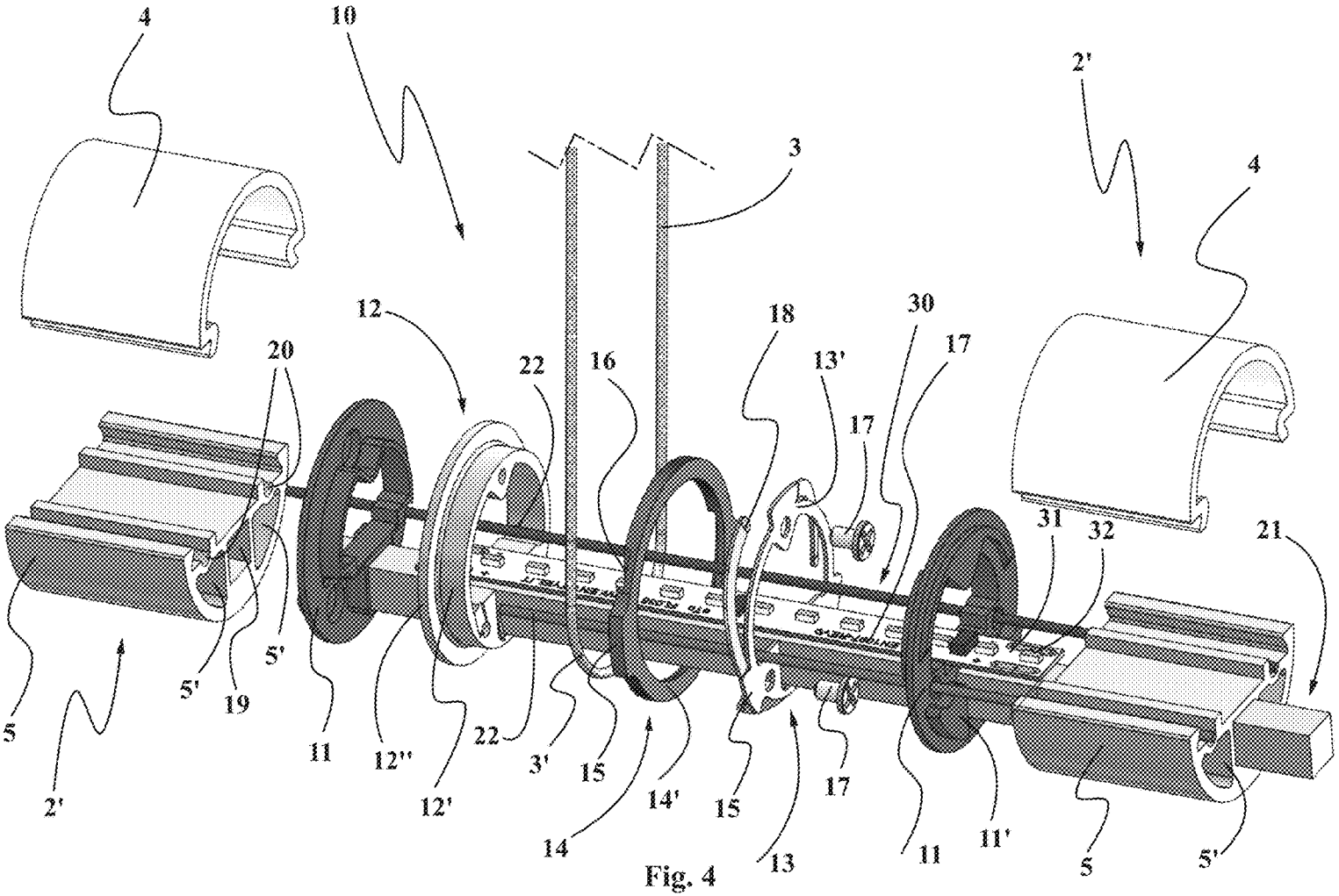
FIG. 4 shows a second exploded schematic view of the detail of the adjustable lamp of FIG. 3 with different fixing elements of side-by-side modules represented by a square bar.
Figure 5:
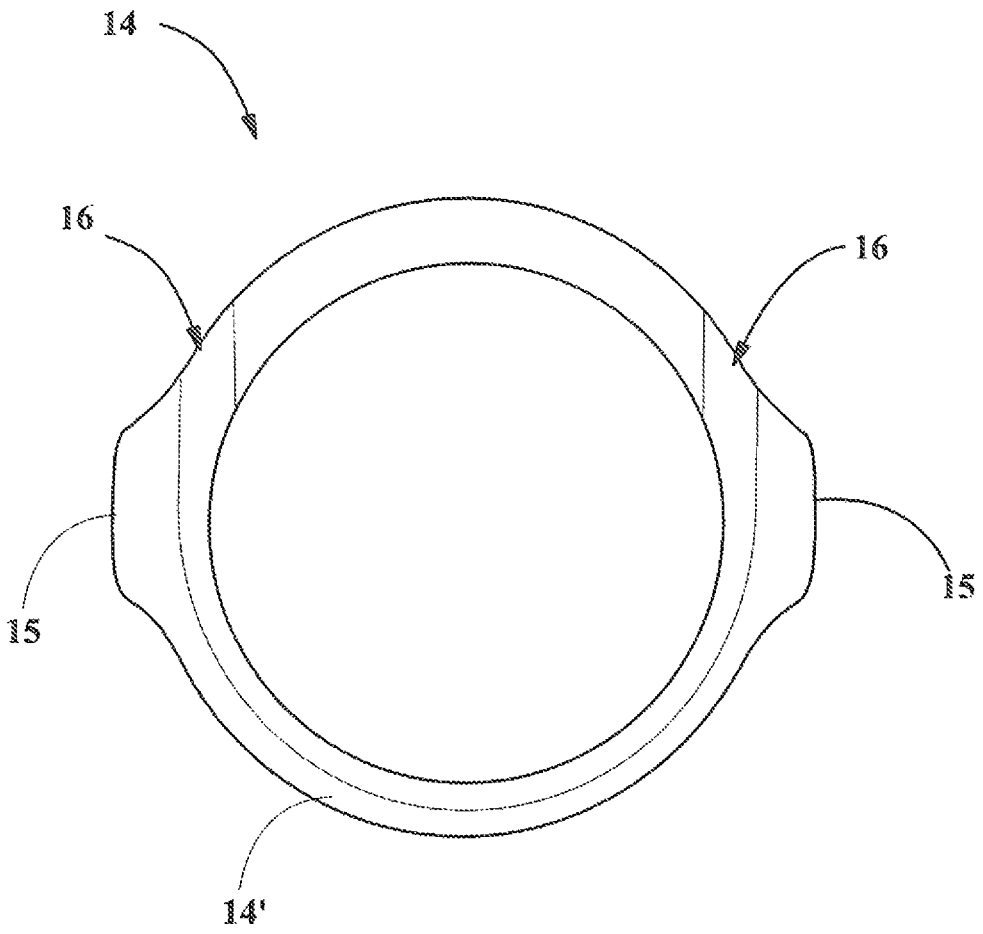
FIG. 5 shows a reverse side view of a guide element 14 of the adjustable lamp of FIG. 3 showing openings 16, wherein the reverse side view depicts a side reverse to the side most visible in FIG. 3.

Otherwise, in accordance with the embodiment of FIG. 4, the fixing elements 21 can comprise at least one shaped bar, for example with polygonal section, in particular a bar with square section, which is inserted with fitting engagement in corresponding holes 19 obtained on the portions of the support bodies 5 of two contiguous modules 2', joining them together. The shaped bars can otherwise, or for safety's sake, be fixed by means of screws or grub screws to the support bodies.

In operation, by bringing such threaded bar under traction, the entire structure of the support body 5 of the illuminating body 2 is compacted and makes a mechanically rigid and mechanically strong structure.

Otherwise, the aforesaid fixing elements 21 of the modules 2' can comprise screws passing through adjacent modules 2' and/or metallic tongues to be applied externally with respect to the illuminating body 2, adapted to firmly lock the joined-together modules 2' by operating outside the support body 5.

Otherwise, in accordance with an embodiment not depicted in the enclosed figures, the fixing elements 21 of the modules 2' can mechanically connect together two contiguous modules 2', allowing the relative rotation thereof. For such purpose, such fixing elements 21 comprise at least one hinge arranged coaxially with respect to the longitudinal axis Y and mechanically connected to the facing transverse faces of two contiguous modules at one section.

For example, the aforesaid hinge can comprise a pin arranged axially fixed to a transverse face of one of the modules 2' and rotatably engaged in an axial seat aligned therewith, obtained in the transverse face of the contiguous module 2'. Such solution allows a free relative rotation of the two contiguous modules 2'.

In particular, the lamp can provide for three aligned modules, of which the end modules are rotatable with respect to the central module.

Still otherwise, in accordance with a further embodiment not depicted in the enclosed figures, the modules 2' of the illuminating body 2 might not be divisible at the electrical connection elements 10 i.e. at the sections of the illuminating body 2. More in detail, in this case the support body 5 can be obtained in one piece with a single body, shaped at the interception sections in order to receive the aforesaid electrical connection elements 10, which will be described in detail below in the course of the description.

Hereinbelow, reference will be made to the preferred but non-limiting embodiment illustrated in the enclosed FIG. 3, which provides for an actual division of the illuminating body 2 in separate modules 2' assembled together at the sections I-I, where the electrical connection elements 10 are provided for and interposed.

In accordance with the idea underlying the present invention, the electrical connection elements 10 comprise a pair of insulating elements 11 of substantially annular shape, which have a traverse size with respect to the longitudinal axis Y preferably analogous to that of a section of the illuminating body 2; in the case schematized in FIG. 3, such insulating elements have a substantially circular ring form, corresponding to the section of the illuminating body 2.

Advantageously, the two aforesaid insulating elements 11 are placed at both longitudinal ends of the electrical connection elements 10 in order to electrically insulate the conductive components of the electrical connection elements, discussed in detail hereinbelow, from the modules 2' of the illuminating body 2.

The insulating elements 11 are mechanically connected to the illuminating body 2 of the adjustable lamp 1, and in particular a pair of insulating elements of the electrical connection elements 10 are engaged with two contiguous modules 2'.

More in detail, each of the insulating elements 11 consists of a shaped wall having a first face transverse to the axis Y directed towards an end face of a module 2' of the illuminating body 2 and adherent thereto, and a second transverse face directed in the opposite direction, i.e. oriented towards the conductive components of the electrical connection elements 10.

Preferably, such first face of each insulating element 11 directed towards one of the modules 2' comprises protuberances 11', which projectingly extend with respect to the first face itself and are mechanically engaged by means of shape coupling in the cavities 5' of the support body 5 of the corresponding module 2'.

The engagement thus advantageously occurs by means of shape coupling of male/female type, as illustrated in FIG. 3, i.e. by means of coupling between the protuberances 11' of each of the two insulating elements 11 and the cavities 5' of the support body 5 of each module 2' of the illuminating body 2.

Advantageously, the electrical connection elements 10 also comprise at least one annular electrode 12 interposed between the insulating elements 11. In particular, such annular electrode 12 is made of conductive metal material, such as copper or aluminum. Such annular electrode 12 is adapted to receive the current conducted by one of the load-bearing electric cables 3, due to a direct and constant electrical contact, in order to then transmit it to the illumination source 30, with modes better explained hereinbelow. The annular electrode 12 is mechanically associated with the illuminating body 2 at a corresponding section, and delimits at least one annular seat housing a curved portion 3' of a corresponding load-bearing electric cable 3.

With the term annular seat, it must be intended hereinbelow a seat at least partly provided on the annular electrode 12 and with extension around the longitudinal axis of the illuminating body 2. Such annular seat preferably has circular shape so as to allow an easy sliding with relative motion with respect to the load-bearing electric cable 3; nevertheless, it can also have different shape, e.g. polyhedron, and also be extended for an angle less than 360 degrees. In such case, the load-bearing electric cable can have a shape corresponding with the annular seat in the curved portion section 3' thereof and the rotations of the illuminating body 2 will correspondingly and preferably be discrete so as to couple the curved portion of the load-bearing electric cable 3 with shape relationship in the annular seat.

For such purpose, the annular electrode 12, in accordance with that illustrated in FIG. 3, preferably comprises a cylindrical wall 12', arranged coaxially with respect to the longitudinal axis Y, and an annular shoulder 12" which is projectingly and radially extended starting from the cylindrical wall 12'. Around such cylindrical wall 12', the U-shaped curved portion 3' of a corresponding load-bearing electric cable 3 is wound.

In accordance with one possible embodiment not represented in the enclosed figures, the annular electrode 12 can have the annular seat obtained in the cylindrical wall 12' with a groove, adapted to house the curved portion 3' of the load-bearing electric cable 3.

The curved portion 3' of the load-bearing electric cable 3 in this case adheres with such cylindrical wall with a pressure also due to the weight of the illuminating body 2. The shoulder 12" prevents the exit of the curved portion 3' of the load-bearing electric cable 3 from the cylindrical wall 12' of the annular electrode 12. Advantageously, the annular seat for housing the curved portion 3' of the load-bearing electric cable 3 is defined by the cylindrical wall 12' in collaboration with the annular shoulder 12".

Advantageously, the electrical connection elements 10 also comprise elastically pliable elements 13, preferably with annular shape, which comprise a main body 13' and are interposed between the two insulating elements 11 and in particular interposed between one of the insulating elements 11 and the annular electrode 12.

In accordance with the embodiment illustrated in the enclosed figures, the load-bearing electric cable 3 advantageously remains interposed between the elastically pliable elements 13 and the annular shoulder 12" of the annular electrode 12 so as to be maintained strongly adhered to the annular electrode 12 due to the elastic force exerted by the aforesaid elastically pliable elements 13, in order to transmit the current from the power supply elements to the annular electrode 12. The aforesaid elastically pliable elements 13 are preferably made of conductive material, for example steel.

In operation, such elastically pliable elements 13 are fixed on the aforesaid annular electrode 12 and exert an elastic force directly or indirectly on the load-bearing electric cable 3 in order to maintain it in the seat of the annular electrode 12, i.e. in particular in order to maintain it pressed against its annular shoulder 12".

In particular, the elastically pliable elements 13, in accordance with the embodiment represented in the enclosed FIG. 3, have at least one, and preferably three, ribs 18 which are projectingly extended from the main body 13' with curved shape in the main extension direction Y towards the annular electrode 12. Such ribs 18 are adapted to apply the abovementioned elastic force on the load-bearing electric cable 3 in order to maintain the electrical contact with the annular electrode 12.

In accordance with the preferred embodiment illustrated in the enclosed figures, the adjustable lamp 1 according to the invention also comprises a guide element 14 preferably interposed between the elastically pliable elements 13 and the annular electrode 12 (see FIG. 3).

Such guide element 14 is preferably made of conductive metal material, such as aluminum or copper, and is adapted to house at least the curved portion 3' of the load-bearing electric cable 3.

More in detail the guide element 14 has annular shape with external diameter substantially equal to that of the section of the illuminating body 2 and of the other elements of the electrical connection elements 10, and has a curved groove that delimits the abovementioned annular seat for housing the curved portion 3' of the load-bearing electric cable 3. Such curved groove for such purpose has a circular extension (or at least extension with circular sector in order to contain the curved portion 3' of the load-bearing electric cable 3), preferably obtained by means of milling, on one face thereof directed transverse to the axis Y. In particular such face is directed towards the annular shoulder 12" of the annular electrode 12.

In accordance with the embodiment of the enclosed figures, such annular shoulder 12" radially projects in order to face the guide element 14. Of course, it can be differently oriented in order to define, with the guide element 14, the annular seat for the load-bearing electric cable 3.

Such guide element 14 also has two openings 16 on its external edge, at two accesses to the curved groove, in order to allow the passage of the curved portion 3' of the load-bearing electric cable 3 into the curved groove itself.

Such groove is preferably open on the face directed towards the annular shoulder 12" of the annular electrode 12, against which it defines the annular seat for retaining the load-bearing electric cable 3.

The guide element 14 has an internal diameter capable of allowing the insertion to size thereof around the cylindrical wall 12' of the annular electrode 12.

The guide element 14 therefore appears mechanically associated with the annular electrode 12, given that it is positioned around the cylindrical wall 12' of the annular electrode 12 itself so as to define through its groove or the annular shoulder 12" the annular seat for retaining the load-bearing electric cable 3.

More clearly, the curved portion 3' of the cable 3 is retained in the annular seat on one side by the curved groove of the guide element 14 and on the other side by the annular electrode 12 with which it is electrically coupled.

The aforesaid curved groove thus conceived therefore allows maintaining the load-bearing electric cable 3 firmly in abutment against the annular electrode 12 for an optimal transmission of the electric current.

The annular electrode 12 is also electrically connected to at least one further electric cable adapted to transmit electric current to the illumination source 30 by traversing the illuminating body 2.

More in detail, the support body 5 has at least one rectilinear groove 20, obtained along its profile and preferably parallel to the longitudinal axis Y, which is covered by the shell 4 when the illuminating body 2 is in its closed configuration. Such rectilinear groove 20 is adapted to house the aforesaid at least one electric cable 22 which transmits the electric current from the annular electrode 12 to the illumination source 30.

Preferably, the elastically pliable elements 13 and the annular electrode 12 are provided with aligned through holes that house retention elements 17, such as screws, in order to fix such elastically pliable elements 13 to the annular electrode 12 (in accordance with the embodiment illustrated in FIG. 3).

Otherwise, the elastically pliable elements 13 can be fixed to an insulating element 11 or directly to the support body 5 of the illuminating body 2.

Otherwise the retention elements 17 can be omitted if the traction exerted by the fixing elements 21 of the modules 2' of the illuminating body 2 is sufficient to allow the axial compaction of the insulating elements 11, of the annular electrode 12 and of the elastically pliable elements 13, such that the latter can express their elastic force on the load-bearing electric cable 3.

Advantageously, the insulating elements 11, the annular electrode 12 and the elastically pliable elements 13 all have annular shape, and each have thickness preferably comprised between 0.2 mm and 30 mm; in addition, they internally delimit a through hole parallel to the axis Y, with a diameter adapted to house the illumination source 30, which as stated preferably consists of a strip 31 of LEDs 32 that is continuously extended, even at the electrical connection elements 10.

Otherwise, the illuminating body 2 of the adjustable lamp 1 can at its interior contain more than one strip 31 of LEDs 32, in particular at least one for each module T of the illuminating body 2.

In addition, the insulating elements 11, the annular electrode 12 and the elastically pliable elements 13 have an external diameter substantially equal to each other and in particular equal to that of the illuminating body 2 which, as stated, preferably has cylindrical tubular shape, in order to obtain a lamp with a simple, clean geometric line, without the divisions of the illuminating body 2 due to the electrical connection elements 10 being visible, hence the adjustable lamp 1, object of the present invention, thus achieved being aesthetically pleasing.

The elastically pliable elements 13 have a projecting grip portion 15 associated therewith that is radially projecting with respect to the external surface of the illuminating body 2 and susceptible of being moved against the action of the elastic force of the elastically pliable elements 13 themselves, along a direction parallel to the longitudinal axis Y.

More particularly, such projecting grip portion 15 is susceptible of being moved between a first operating position in which the elastically pliable elements 13 push the load-bearing electric cable 3 in contact with the annular electrode 12 inside the annular seat and a second adjustment position in which the elastic force is overcome and said elastically pliable elements 13 free said load-bearing electric cable 3 from the annular seat.

After having overcome the elastic force exerted by the aforesaid elastically pliable elements 13, maintaining the projecting portion 15 displaced, the load-bearing electric cable 3 is no longer constrained to the electrical connection elements 10 (i.e. in the seat of the annular electrode 12) where it was forced by the elastic force, and it is possible to disconnect the load-bearing electric cable 3 from the illuminating body 2, or even rotate the illuminating body 2 of the adjustable lamp 1 around its longitudinal main extension axis Y in an easier manner, in order to change the tilt angle of the light cone irradiated by the illumination source 30. During the rotation of the illuminating body 2, the load-bearing electric cable 3 does not rotate, hence able to remain in contact—mechanical and electrical—with the annular electrode 12.

In particular, the curved portion 3' of the load-bearing electric cable 3 slides, remaining stopped with respect to the rotary movement, in the annular seat obtained due to the annular shoulder 12" of the annular electrode 12 with the rotation of the annular seat itself, which is mechanically constrained to the illuminating body 2. In such a manner the adjustable lamp 1 allows orienting the light cone irradiated by the illumination source 30 by rotating the illuminating body 2 around the axis Y without restrictions or limitations.

Once the projecting grip portion 15 of the elastically pliable elements 13 is released, the elastic three returns to exerting the elastic force on the load-bearing electric cable 3, in fact constraining the latter to the annular electrode 12 and then to the illuminating body 2, i.e. preferably actually blocking the relative sliding of the cable 3. In such a manner, it is thus possible to rotate and then lock the adjustable lamp 1 in any desired position without limitations and without stress by the user, in particular such position of the adjustable lamp 1 selected by the user is maintained without sliding due to the inertia of the illuminating body 2, due to the elastic force applied by the elastically pliable elements 13 on the curved portion 3' of the load-bearing electric cable 3.

The projecting grip portion 15 of the elastically pliable elements 13 is, as stated, susceptible of being moved against the action of the elastic force in a direction parallel to the longitudinal axis Y, as explained above.

If such elastically pliable elements 13 undergoes a rather large movement, so to open a slit with the annular electrode 12 of width greater than or equal to the thickness of the load-bearing electric cable 3, the latter is susceptible of being removed by the user from its seat of the annular electrode 12, and then be completely extracted from the connection elements 10, so as to completely release it from the illuminating body 2.

In this manner, it is then possible to remove the illuminating body 2 from the mechanical and electrical constraint with the load-bearing electric cables 3 in a quick and simple manner, easily allowing the cleaning of the illuminating body 2 itself or allowing performing normal maintenance or repair operations.

Advantageously, in accordance with this preferred embodiment, the abovementioned at least one projecting grip portion 15 (and preferably the two already considered above is provided on the guide element 14 projecting from the external circumference thereof so as to also project with respect to the external surface of the illuminating body 2 for an easy manual gripping.

In operation, by operating on such projecting grip portions 15, the user moves the guide element 14 against the action of the elastically pliable elements 13 in order to release the load-bearing electric cable 3 from the annular electrode 12, i.e. the pressure thereof is decreased in order to allow the illuminating body 2 to be easily rotated around its axis Y (or even for separating the illuminating body from the load-bearing electric cables 3), as occurs in the previously-illustrated embodiment.

During such rotation of the illuminating body 2, the guide element 14 is mechanically constrained to the load-bearing electric cable 3, in particular to its curved portion 3' and hence it does not rotate with the rotation of the illuminating body 2.

In particular, the guide element 14 is mounted on the cylindrical wall 12' of the annular electrode 12 with a clearance adapted to allow a rotation of the latter for the orientation of the lamp 1.

Advantageously, the illuminating body 2 of the adjustable lamp 1 comprises at least two lateral closure covers, preferably with circular section, which are mounted with shape engagement on the ends of the illuminating body 2 with tubular shape in order to close such ends and make the geometric line of the adjustable lamp 1 uniform. In particular, such lateral covers are intended to be mechanically constrained to the illuminating body 2 by means of fitting and/or male/female coupling obtained by means of their protuberances engaged in the longitudinal cavities 5' of the support body 5.

Advantageously, the adjustable lamp 1 comprises at least one regulator of the electrical power absorption by the illumination source 30, e.g. an electronic dimmer, in order to optimize the electrical energy consumption during the use of the adjustable lamp 1 itself.

Preferably, such power absorption regulator is installed at a lateral terminal of the illuminating body 2 and is covered by one of the two lateral covers, becoming invisible from the outside in order to prevent compromising the aesthetic line of the adjustable lamp 1.

The adjustable lamp 1 thus conceived therefore attains the pre-established objects.

The invention claimed is:

1. An adjustable lamp for illuminating a setting, which comprises:

two electrically-conductive load-bearing electric cables each having a curved portion;

an illuminating body extended with main extension along a longitudinal axis (Y), supported suspended by said electrically-conductive load-bearing electric cables and comprising at least one illumination source;

first and second electrical connection elements mechanically associated with the illuminating body at two corresponding sections thereof spaced from each other, respectively electrically connected to said corresponding two electrically-conductive load-bearing electric cables in order to electrically power said adjustable lamp;

wherein said first and second electrical connection elements each comprise:

an annular electrode, which is mechanically associated with said illuminating body at the corresponding section, and delimits an annular seat housing the curved portion of the corresponding said electrically-conductive load-bearing electric cable;

a pair of insulating elements, which are mechanically associated with said illuminating body, mounted at the corresponding section with said annular electrode interposed in order to electrically insulate said annular electrode;

elastically pliable elements, interposed between an insulating element of said pair of insulating elements and said annular electrode, which exert a pressure on the corresponding said electrically-conductive load-bearing electric cables, maintaining said electrically-conductive load-bearing electric cable in contact against said annular electrode.

2. The adjustable lamp for illuminating a setting according to claim 1, further comprising at least one guide element made of electrically conductive material, interposed between said annular electrode and said elastically pliable elements, having a curved groove for housing the curved portion of said electrically-conductive load-bearing electric cable, and that is free to slide with respect to said illuminating body during the rotation of said illuminating body around the longitudinal axis (Y).

3. The adjustable lamp for illuminating a setting according to claim 2, wherein said guide element is mechanically engaged with said annular electrode and provided with said curved groove; said curved groove being provided with at least two openings traversed by said electrically-conductive load-bearing electric cable; said guide element being provided with at least one projecting grip portion that is radially projecting and susceptible of being moved against the action of the elastically pliable elements along the longitudinal axis (Y) between a first operating position in which said elastically pliable elements push said electrically-conductive load-bearing electric cable in contact with said annular electrode inside said curved groove and a second adjustment position in which said elastically pliable elements free said electrically-conductive load-bearing electric cable from said curved groove.

4. The adjustable lamp for illuminating a setting according to claim 2, wherein said annular electrode comprises an annular shoulder which delimits the annular seat of said electrically-conductive load-bearing electric cable, which is pushed by said elastically pliable elements in abutment against said annular electrode.

5. The adjustable lamp for illuminating a setting according to claim 4, wherein said annular electrode comprises a cylindrical wall coaxial with said longitudinal axis (Y) of said illuminating body, from which said annular shoulder is radially extended.

6. The adjustable lamp for illuminating a setting according to claim 2, wherein said elastically pliable elements have a main body and at least one rib which is projectingly extended from said main body in the longitudinal axis (Y) towards the annular electrode.

7. The adjustable lamp for illuminating a setting according to claim 1, wherein said extended illuminating body comprises: at least three modules; at least one support body of rigid material adapted to house said illumination source; fixing elements, placed in at least one through hole obtained inside said support body of said illuminating body along its extension according to the longitudinal axis (Y) in order to join said modules; at least one shell of at least partially transparent plastic material, mechanically engaged with said support body and intended to cover said illumination source.

8. The adjustable lamp for illuminating a setting according to claim 7, wherein said insulating elements are mechanically constrained to said illuminating body by means of protuberances of said insulating element fittingly engaged with cavities obtained in an end face orthogonal to said longitudinal axis (Y) of said support body.

9. The adjustable lamp for illuminating a setting according to claim 7, wherein said electrical connection elements divide said illuminating body into three said modules separated from each other.

10. The adjustable lamp for illuminating a setting according to claim 7, wherein said support body of said illuminating body comprises at least one rectilinear groove parallel to said longitudinal axis (Y), which receives at least one further electric power supply cable, which is extended at least from said annular electrode to said illumination source in order to power said illumination source.

11. The adjustable lamp for illuminating a setting according to claim 1, wherein said elastically pliable elements are made of electrically conductive metallic material.

12. The adjustable lamp for illuminating a setting according to claim 1, further comprising at least one regulator of electrical power absorption.

* * * * *